US008752221B2

(12) United States Patent
Ortega

(10) Patent No.: US 8,752,221 B2
(45) Date of Patent: Jun. 17, 2014

(54) SUPPORT APPARATUS

(76) Inventor: Melissa Diane Ortega, Peshastin, WA (US)

( * ) Notice: Subject to any disclaimer, the term of this patent is extended or adjusted under 35 U.S.C. 154(b) by 452 days.

(21) Appl. No.: 13/156,126

(22) Filed: Jun. 8, 2011

(65) Prior Publication Data

US 2011/0296614 A1 Dec. 8, 2011

Related U.S. Application Data

(60) Provisional application No. 61/397,352, filed on Jun. 8, 2010.

(51) Int. Cl.
*A47C 20/00* (2006.01)

(52) U.S. Cl.
USPC ..... 5/630; 5/632; 5/652; 5/654; 5/655.3; 5/656; 5/706; 5/710

(58) Field of Classification Search
USPC ..... 5/630, 632, 652, 654, 655, 655.3, 656, 5/706, 710, 731; 4/496, 571.1, 573.1, 4/585, 588
See application file for complete search history.

(56) References Cited

U.S. PATENT DOCUMENTS

| | | | | |
|---|---|---|---|---|
| 3,689,947 | A | 9/1972 | Wolf | |
| 4,302,860 | A | 12/1981 | Puch | |
| 4,484,781 | A * | 11/1984 | Phelps | 297/452.41 |
| D278,004 | S | 3/1985 | Sigona | |
| 4,726,556 | A * | 2/1988 | Weir | 248/454 |
| 4,967,992 | A | 11/1990 | Menaged | |
| 4,987,625 | A | 1/1991 | Edelson | |
| 5,042,874 | A | 8/1991 | Williams | |
| 5,121,961 | A | 6/1992 | Marshall | |
| 5,299,337 | A | 4/1994 | Venza | |
| 5,628,544 | A * | 5/1997 | Goodman et al. | 297/188.14 |
| D406,870 | S | 3/1999 | Bauman | |
| 5,946,749 | A | 9/1999 | Sewell | |
| 6,224,444 | B1 * | 5/2001 | Klimenko | 441/130 |
| 6,553,591 | B1 | 4/2003 | Motosko | |
| 6,659,822 | B1 | 12/2003 | Dombeck | |
| 6,938,287 | B1 * | 9/2005 | Mahshie | 5/111 |
| 7,051,386 | B2 | 5/2006 | Stewart et al. | |
| 7,174,585 | B1 | 2/2007 | Sorrentino et al. | |
| 7,360,266 | B2 | 4/2008 | Kasatshko | |

(Continued)

FOREIGN PATENT DOCUMENTS

| | | |
|---|---|---|
| KP | 2011033159 | 3/2011 |

*Primary Examiner* — Robert G Santos
*Assistant Examiner* — David E Sosnowski
(74) *Attorney, Agent, or Firm* — JP Webb; Jason P. Webb; Danny Y. H. Cheng

(57) ABSTRACT

A support apparatus configured to support a prone user in a position that is conducive to interacting with a media item that is also supported thereon. The apparatus includes an upper body support that is configured to support an upper body of a prone user. The upper body support includes a base support member that provides a cushioned surface. The upper body support includes a chest support member extending upwardly from the base support member. The apparatus includes a strip extending frontwardly from the upper body support. The strip is a sheet of flexible material is a width that is substantially equal to the base support member. The apparatus includes a media support member that is coupled to the strip, opposite of the upper body support. The media support member includes a media support structure that is configured to support a media item in a viewable position.

1 Claim, 8 Drawing Sheets

(56) References Cited

U.S. PATENT DOCUMENTS

| | | | | |
|---|---|---|---|---|
| 7,536,740 | B1 | 5/2009 | Swartz | |
| 7,547,071 | B2 | 6/2009 | Huffman | |
| 7,986,527 | B2 * | 7/2011 | Sween et al. | 361/695 |
| 2006/0061180 | A1 * | 3/2006 | Scheurer et al. | 297/354.13 |
| 2008/0149801 | A1 | 6/2008 | Wood | |
| 2008/0256714 | A1 * | 10/2008 | Cubbage et al. | 5/656 |

* cited by examiner

SUPPORT APPARATUS

CROSS-REFERENCE TO RELATED APPLICATIONS

This invention claims priority, under 35 U.S.C. §120, to the U.S. Provisional Patent Application No. 61/397,352 to Melissa Diane Ortega filed on Jun. 8, 2010, which is incorporated by reference herein.

BACKGROUND OF THE INVENTION

1. Field of the Invention

The present invention relates to recreational support apparatuses, specifically to a support apparatus for supporting a user and a media item.

2. Description of the Related Art

Reading a book usually requires the user to use at least one hand, and sometimes both hands are needed to hold the book open, as books have a tendency to self close. Manually holding a book open for an extended period of time can be tiring, particularly if you are lounging or in a prone position. Holding a book open for long periods of time can also be inconvenient and may cause discomfort for the user. Previous devices have been used to support a book at a convenient position or angle, such as a lectern or some other inclined surface, and some other ones also hold the pages of the book open. Some improvements have been made in the field. Examples of references related to the present invention are described below in their own words, and the supporting teachings of each reference are incorporated by reference herein:

U.S. Pat. No. 5,946,749, issued to Sewell, discloses a comfort lounge chair comprising a seat member for supporting a lower torso and legs of a person in a prone position. A structure elevates the seat member up off of an underlaying surface. A back portion is pivotally connected to the seat member for supporting an upper torso, arms and head of the person in the prone position. The back portion has an opening therethrough, so that the opening can comfortably receive a face of the person lying on their stomach in the prone position, without obstruction of eyes nose and mouth.

U.S. Pat. No. 5,299,337, issued to Venza, discloses a portable chair includes a first container for retaining items, the first container having an inclined top wall for use as a back rest. The chair may additionally include a second container for retaining items, the second container having an inclined top wall and being hingedly connected to the first container such that the first container can pivot onto the inclined top wall of the second container, such that the inclined top wall of the second container can be pivoted into alignment with the inclined top wall of the first container, for use together as a back rest, and a third container for retaining items, the third container having a substantially horizontal top wall and being connected to the second container such that the second container can pivot together with the first container onto the substantially horizontal top wall of the third container. An access opening is preferably provided in at least one container. A canopy assembly is optionally provided over the containers. Also optionally included is a shoulder strap for use in carrying the portable chair. A method of closing the chair for transport and storage includes the steps of pivoting the first container onto the second container, and pivoting the first and second containers onto the third container. A method of opening the chair for use includes the steps of pivoting the first and second containers off the third container and against the ground, and pivoting the first container off the second container and against the ground.

U.S. Pat. No. 5,121,961, issued to Marshall, discloses an apparatus including a torso support housing, with a first and second leg support housing mounted longitudinally and pivotally relative to one another to permit interfolding of the structure during periods of transport and storage. The torso support housing includes a support leg receiving cavity to receive a pivotal support leg therewithin to enhance compactness of the organization in a stored and interfolding configuration. The organization further includes pneumatic chambers mounted coextensively with top surfaces of each support housing and selectively inflatable for enhanced comfort of an individual. A cup support holder and handle are retractably mounted within the torso support housing.

U.S. Pat. No. 4,967,992, issued to Menaged, discloses an inflatable reading stand comprising an inflatable main body attached in air tight relation to an elongated base portion having a support edge, the main body including an exposed surface structured to support a book or other reading material thereon, the elongated base having a hand pump and hose assembly attached thereto to permit inflation and deflation of the main body whereby the angle of the exposed surface can be adjusted relative to the horizontal plane thereby allowing the user to view any reading material placed thereon while sitting in a comfortable, upright sitting position.

U.S. Patent Application Publication No.: 2008/0149801, by Wood, discloses a device to hold an open book at an open page is disclosed in which the page is clamped between a lip (1, 21) and a resilient book cover support (3, 23). Two embodiments of the device (10, 20) are disclosed, the former being fabricated as a single piece, the latter being able to be folded for compact packaging. In either case pages of the open book can be turned at will.

The inventions heretofore known suffer from a number of disadvantages which include being limited in use, being limited in adjustability, being uncomfortable, being difficult to use, being expensive, being dangerous, being difficult to manufacture, being difficult to store, being overly complicated, being messy, and/or being awkward to use or carry.

What is needed is a support apparatus that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available support apparatuses. Accordingly, the present invention has been developed to provide a support apparatus for supporting a user and a media item.

According to one embodiment of the invention, there is a support apparatus that may be configured to support a prone user in a position that may be conducive to interacting with a media item that may be also supported thereon. The apparatus may include an upper body support that may be configured to support an upper body of a prone user in a position such that a face of a user may be elevated. The upper body support may include a base support member that may provide a cushioned surface and may be configured to provide stability. The upper body support may include a chest support member that may extend upwardly from the base support member and may be configured to provide a cushioned rest for a chest of a user. The chest support member may include a top surface that may be angled relative to the base support member such that a face of a user may be directed forwardly. The chest support member may be removably coupleable to the base support member.

The apparatus may include a strip that may extend frontwardly from the upper body support. The strip may be a sheet of flexible material that may have a width that may be substantially equal to the base support member. The strip may include a removably coupleable device selected from the group of coupling devices consisting of: snaps, buttons, hook and loop, tongue and groove, clips, clamps, or magnets.

The apparatus may include a media support member that may be coupled to the strip, opposite of the upper body support. The media support member may include a media support structure that may be configured to support a media item in a viewable position. The media support member may include a plurality of elongated restraining members that may be coupled across an operating surface of the media support member. The media support member may include a handle that may extend upwardly therefrom. The media support member may include an insulation chamber that may be configured to store items.

The apparatus may include a beverage support member that may extend outwardly from the media support member and may include a cavity. One of at least the upper body support and the media support member may be inflatable. The strip may be removeably coupleable to at least one of the media support member and the upper body support.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
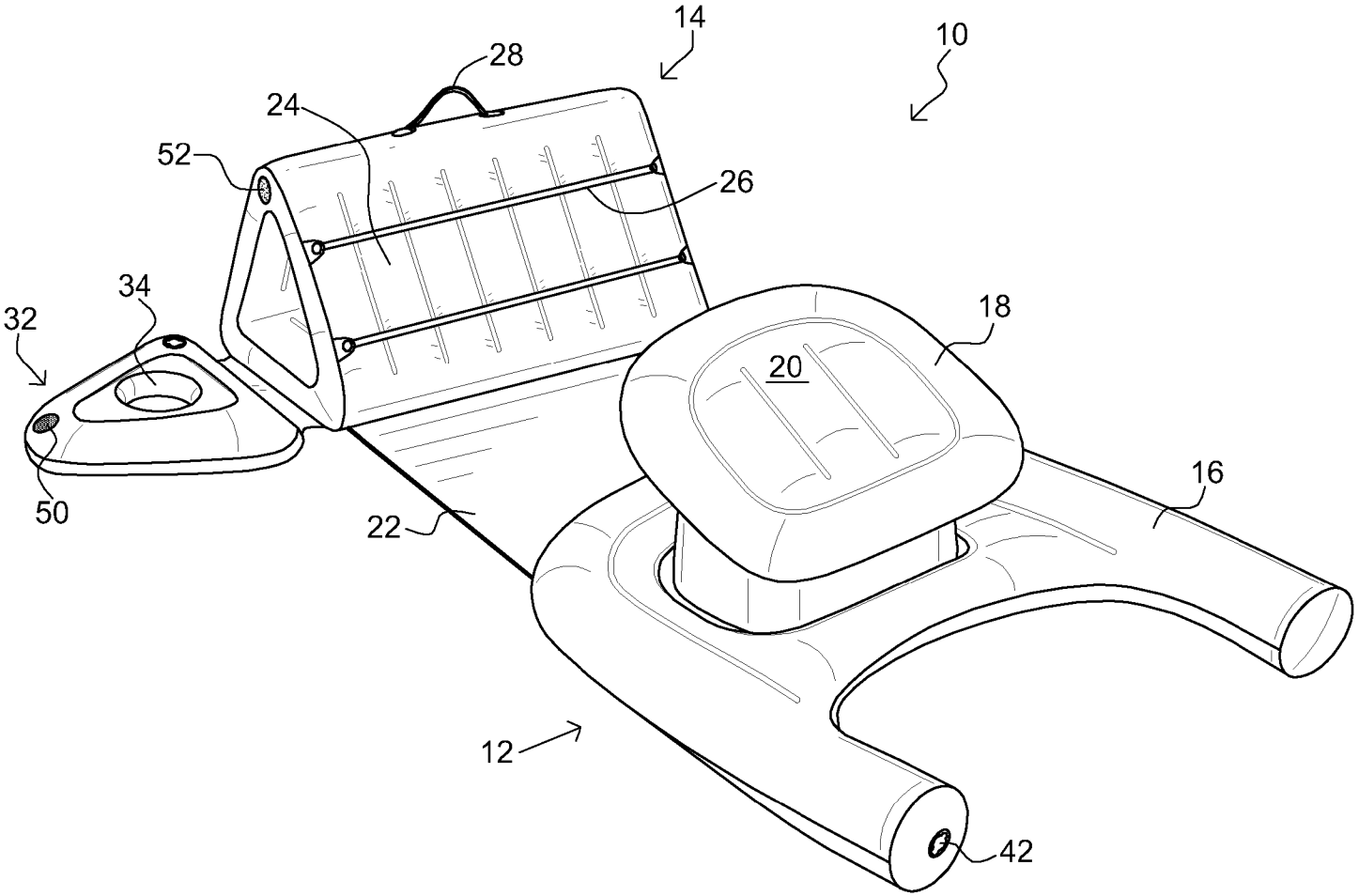
FIG. 1 is a perspective view of a support apparatus, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a support apparatus, according to one embodiment of the invention. There is shown a support apparatus 10 including an upper body support 12 coupled to a media support member 14 and configured to support a prone user in a position that is conducive to interacting with a media item that is also supported thereon. Non-limiting examples of a media item may be: a book, a magazine, a journal, a newspaper, a iPad, a notepad, etc. The illustrated apparatus 10 includes an upper body support 12 that is configured to support an upper body of a prone user in a position such that a face of a user is elevated. The upper body support 12 includes a base support member 16 that provides a cushioned surface and is configured to provide stability. The illustrated base support member 16 includes a selectably sealable aperture 42 configured to provide an opening for the user to inflate the upper body support 12 to a desired air level.

The illustrated upper body support 12 includes a chest support member 18 that extends upwardly from the base support member 16 and is configured to provide a cushioned rest for a chest of a user. The chest support member 18 includes a top surface 20 that is angled relative to the base support member 16 such that a face of a user is directed forwardly. The chest support member includes a U-shaped or horse-shoe shaped portion that may be called an armrest shelf and is configured to provide support to a person's sides and/or arms. The armrest shelf extends backwardly from the main body of the chest support member on either side of where a person may lie when the apparatus is in use.

The illustrated apparatus 10 includes a strip 22 that extends frontwardly from the upper body support 12. The apparatus 10 includes a media support member 14 that is coupled to the strip 22, opposite of the upper body support 12. The media support member 14 includes a media support structure 24 that is configured to support a media item in a viewable position. The media support member 14 includes a plurality of elongated restraining members 26 that are coupled across an operating surface of the media support structure 24 of the media support member 14. The elongated restraining members 26 are configured to secure a media item in an open position, so that the user may view the contents of the media item without having to hold the media item open with a hand or both hands. The elongated restraining members 26 include a flexible material configured to provide elasticity to each restraining member to easily position and couple a media item thereto. The media support member 14 also includes a handle 28 that extends upwardly therefrom, to transport the apparatus 10.

The illustrated apparatus 10 includes a beverage support member 32 that extends outwardly from the media support member 14 and includes a cavity 34. The illustrated upper body support 12 and the media support member 14 are inflatable. The illustrated strip 22 is removeably coupleable to at least one of the media support member 14 and/or the upper body support 12. Such coupling may be effectuated by buttons, snaps, hook and loop, protrusions, friction fittings, tongue and groove, and the like and combinations thereof. The beverage support member 32 includes a first attachment member 50 configured to selectably couple to a second attachment member 52 disposed on the media support member 18. The beverage support member 32 is coupled to the media support such that it may pivot upwards when not in use, wherein the first attachment member 50 selectably couples to the second attachment member 52. Non-limiting examples of a attachment member may be: a hook and loop attachment device, magnetic attachment devices, Velcro attachment members, etc.

There may be a pouch coupled to an exterior surface of the apparatus that may be configured to support an electronic device such as but not limited to an MPS player, ipod, cell phone, smart phone and the like and may be in reach of a user during operation thereof. There may be a pouch or compartment disposed within the media support and operationally coupled to the cavity therein such that cold materials may be placed therein to keep the cavity temperature lower than otherwise. As non-limiting examples cold materials may include ice, freezer packs, frozen materials, and the like.

In one embodiment, there is an inflatable lounge and media holder, including three pieces that detach/re-attach to/from each other. There is a chest piece (chest support member), a center piece (strip), and a media holder (media support member). It may allow you to lie on your stomach and read, sunbathe or just relax in comfort. The chest piece supports your upper body in an ergonomic fashion and may advantageously reduce stress on your shoulders, arms, elbows, neck, and/or etc. One may also use such while lying on ones back. It may allow one to adjust how upright one sits and/or also provides arm rests. The chest piece may include one or more portions that are detachable and may be used in the water in a manner similar to a "noodle" float, wherein the portion is inflated or otherwise floats on water.

The center piece is a connector between the chest piece and the media holder. It may be inflatable and/or may be a thin film of connective material. It may be adjustable for arm length and for distance needed for reading. It provides a surface to protect any media being placed on it or being held up in place. When all pieces are attached the center piece keeps the integrity of the device intact as it holds everything together. The media holder may be triangular in shape and angled such that a book, ipad, magazine or the like can rest on the holder and for positioning the media for easy viewing. It may also have straps such that if the media has pages it will hold them in place for the user to read hands-free. The straps may be flexible so that the pages can be turned easily without having to remove the book/magazine. The media holder may also be hollow and/or provide a space for storage of small items such as a phone, sunglasses, ipod, keys etc. The device may also have a cup holder that may be attached to the media holder and/or may double as a "door" to the hollow area and may secure items inside as needed. The chest portion may double as a pillow when removed and/or as a flotation device.

The apparatus may be inflatable, such that when deflated it may be carried and/or stored in a compact state. The apparatus may include foam and/or other materials, especially light and/or soft/flexible materials and/or materials that will float in water.

Figure 2:
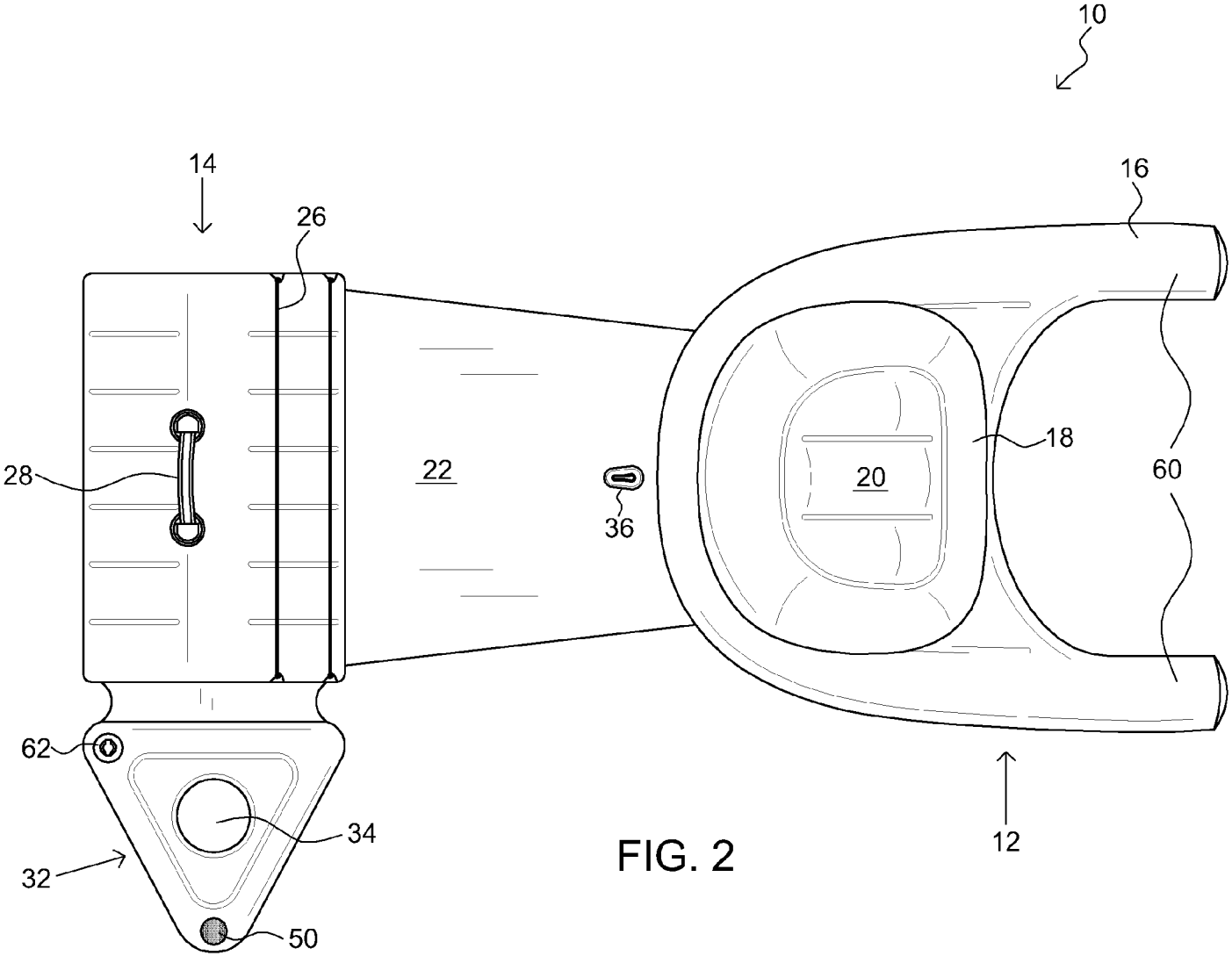
FIG. 2 is a top plan view of a support apparatus, according to one embodiment of the invention.

FIG. 2 is a top plan view of a support apparatus, according to one embodiment of the invention. There is shown a support apparatus 10 including an upper body support 12 and a media support member 14.

The illustrated support apparatus 10 includes an upper body support 12 that is configured to support an upper body of a prone user. The upper body support 12 includes a base support member 16 that provides a cushioned surface and is configured to provide stability. The illustrated base support member 16 includes a pair of arms 60 configured to support a user around the mid section.

The illustrated upper body support 12 includes a chest support member 18 that extends upwardly from the base support member 16 and is configured to provide a cushioned rest for a chest of a user. The chest support member 18 includes a top surface 20 that is angled relative to the base support member 16 such that a face of a user is directed forwardly. The chest support member 18 is removably coupleable to the base support member 16.

The illustrated apparatus 10 includes a strip 22 that extends frontwardly from the upper body support 12. The strip 22 is a sheet of flexible material that includes a width that is substantially equal to the width of the base support member 16. The strip 22 includes a removably coupleable device 36 selected from the group of coupling devices consisting of: snaps, buttons, hook and loop, tongue and groove, clips, clamps, or magnets. The illustrated removably coupleable device 36 is configured to couple the upper body support 12 and a media support member 14 to the strip 22.

The media support member 14 is coupled to the strip 22, opposite of the upper body support 12. The media support member 14 includes a media support structure that is configured to support a media item in a viewable position. The media support member 14 includes a plurality of elongated restraining members 26 that are coupled across an operating surface of the media support member 14. The media support member 14 includes a handle 28 that extends upwardly therefrom.

The illustrated apparatus 10 includes a beverage support member 32 that extends outwardly from the media support member 14 and includes a cavity 34. The illustrated beverage support member 32 includes a selectably sealable aperture 62 configured to provide an opening for the user to inflate the beverage support member 32.

Figure 3:
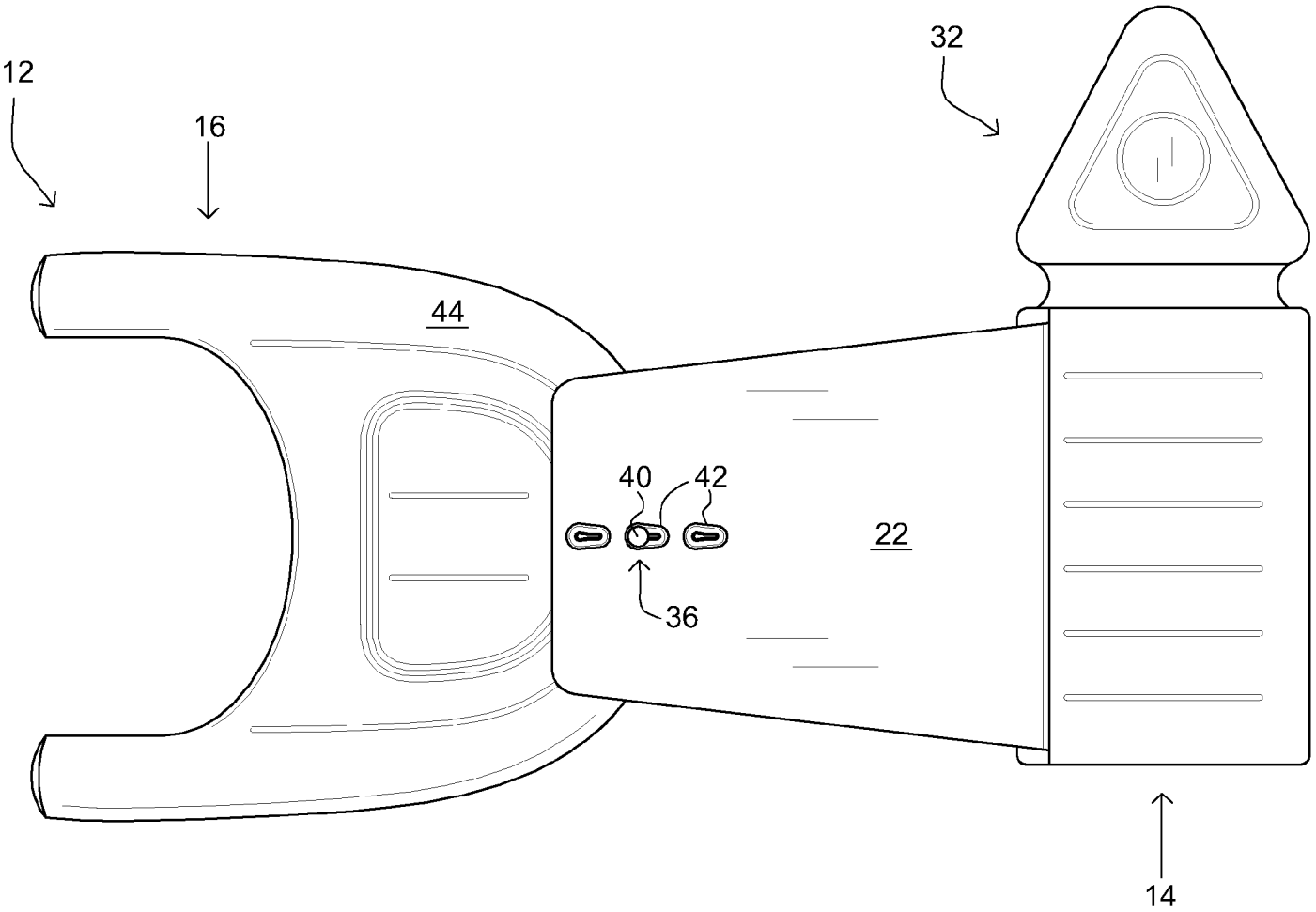
FIG. 3 is a bottom plan view of a support apparatus, according to one embodiment of the invention.

FIG. 3 is a bottom plan view of a support apparatus, according to one embodiment of the invention. There is shown an apparatus including an upper body support 12 and a media support member 14.

The illustrated support apparatus includes an upper body support 12 and a media support member 14 coupled together by a strip 22. The upper body support 12 includes a base support member 16 configured to provide stability to the apparatus. The illustrated strip 22 extends frontwardly from the upper body support 12 and couples to the media support member 14 thereto. The strip 22 is a sheet of flexible material that includes a width that is substantially equal to the width of the base support member 16. The strip 22 includes a removably coupleable device 36 selected from the group of coupling devices consisting of: snaps, buttons, hook and loop, tongue and groove, clips, clamps, or magnets. The illustrated removably coupleable device 36 includes an anchor 40 disposed on a bottom surface 44 of the base support member 16. The anchor 40 is configured to selectably couple to one of a plurality of receiving apertures 42. The anchor 40 is configured to extend through an aperture 42, thereby securing the strip 22 to the upper body support 12.

The apparatus includes a media support member 14 that is coupled to the strip 22, opposite of the upper body support 12. The apparatus includes a beverage support member 32 that extends outwardly from the media support member 14. The illustrated upper body support 12 and the media support member 14 are inflatable.

Figure 4:
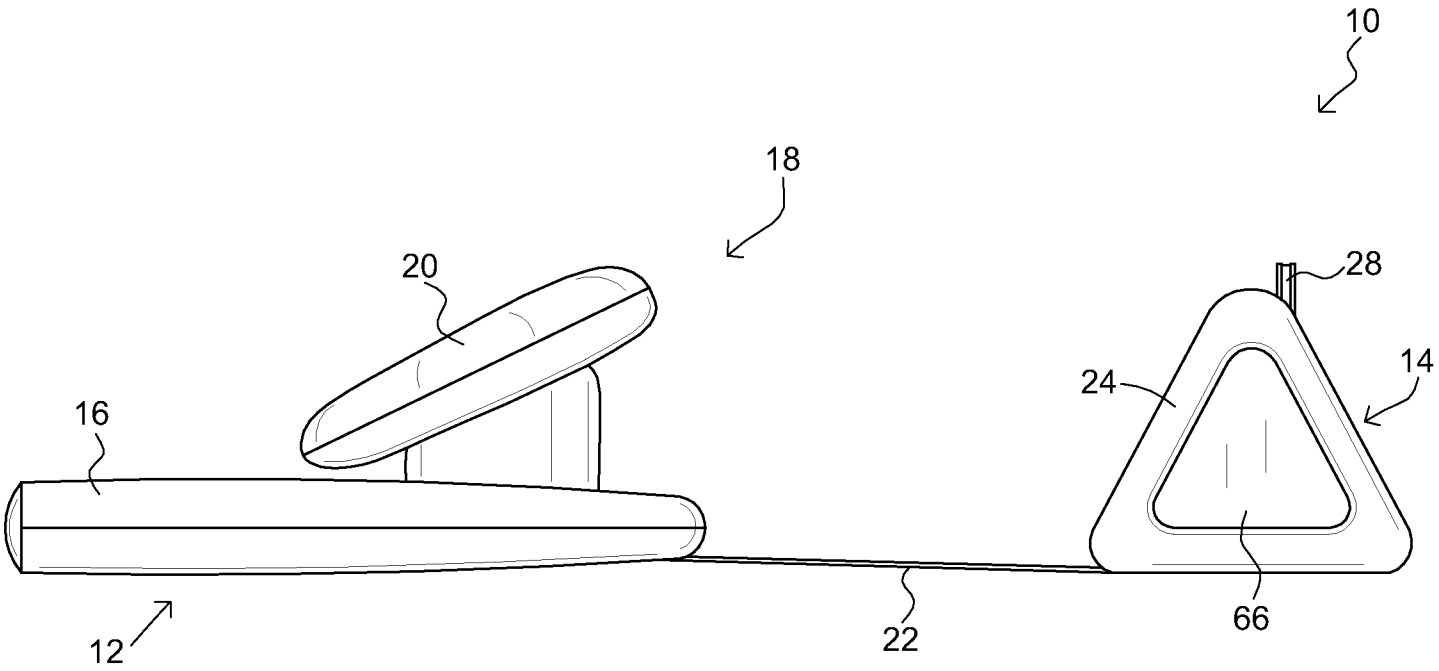
FIG. 4 is a right side elevational view of a support apparatus, according to one embodiment of the invention.

FIG. 4 is a left side elevational view of a support apparatus, according to one embodiment of the invention. There is shown a support apparatus 10 including an upper body support 12 and a media support member 14.

The illustrated support apparatus 10 includes an upper body support 12 that is configured to support an upper body of a prone user in a position such that a face of a user is elevated. The upper body support 12 includes a base support member 16 that provides a cushioned surface and is configured to provide stability. The illustrated upper body support 12 includes a chest support member 18 that extends upwardly from the base support member 16 and is configured to provide a cushioned rest for a chest of a user. The chest support member 18 includes a top surface 20 that is angled relative to the base support member 16 such that a face of a user is directed forwardly.

The illustrated apparatus 10 includes a strip 22 that extends frontwardly from the upper body support 12. The apparatus 10 includes a media support member 14 that is coupled to the strip 22, opposite of the upper body support 12. The media support member 14 includes a media support structure 24 that is configured to support a media item in a viewable position. The media support member 14 includes a handle 28 that extends upwardly therefrom. The media support member 14 includes a sealed end 66 configured to secure items stored within the media support member 14.

Figure 5:
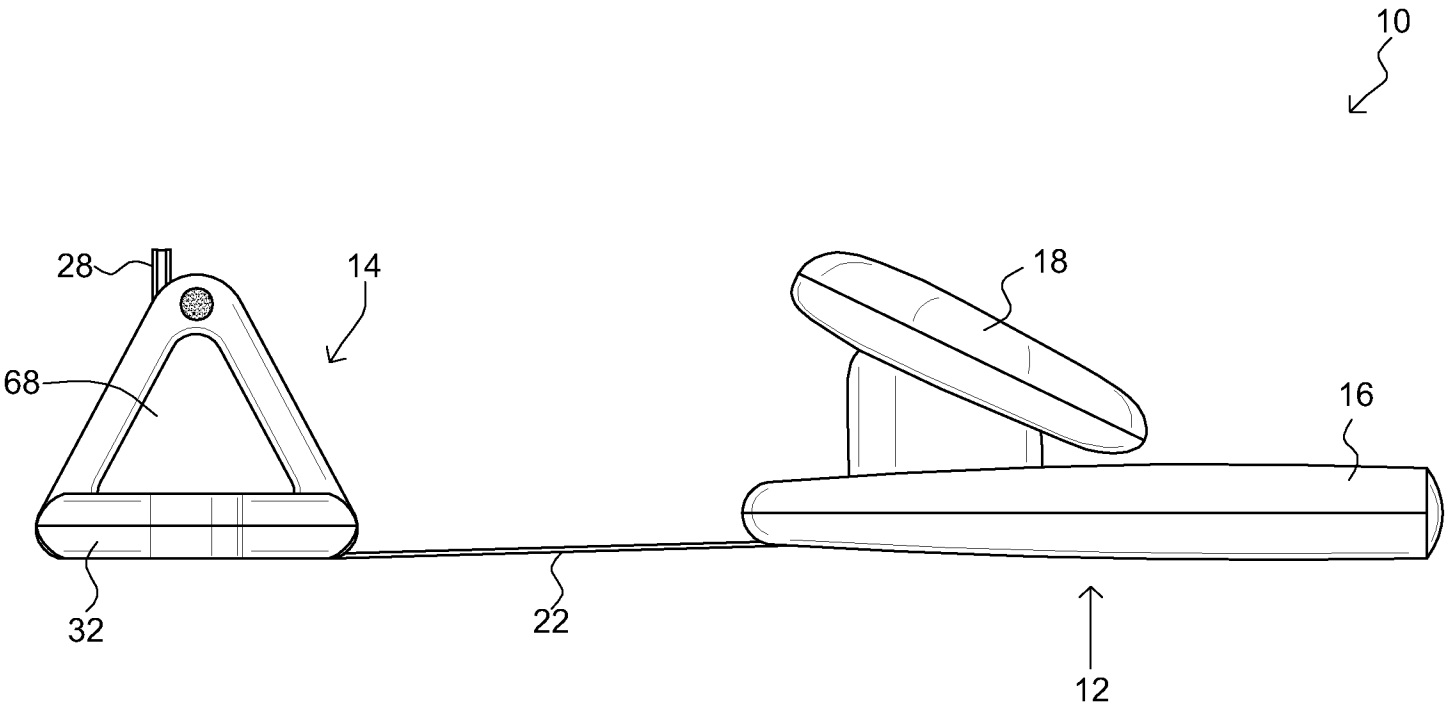
FIG. 5 is a left side elevational view of a support apparatus, according to one embodiment of the invention.

FIG. 5 is a right side elevational view of a support apparatus, according to one embodiment of the invention. There is shown a support apparatus 10 including an upper body support 12 and a media support member 14.

The illustrated support apparatus 10 is configured to support a prone user in a position that is conducive to interacting with a media item that is also supported thereon. The apparatus 10 includes an upper body support 12 having a base support member 16 that provides a cushioned surface and is configured to provide stability. The illustrated upper body support 12 includes a chest support member 18 that extends upwardly from the base support member 16 and is configured to provide a cushioned rest for a chest of a user. The chest support member 18 is removably coupleable to the base support member 16.

The illustrated apparatus 10 includes a strip 22 that extends frontwardly from the upper body support 12. The apparatus 10 includes a media support member 14 that is coupled to the strip 22, opposite of the upper body support 12. The media support member 14 includes a handle 28 that extends upwardly therefrom. The media support member 14 includes an selectably openable aperture 68 disposed about a side of the media support member 14. The aperture 68 is configured to receive items to be stored within the media support member 14.

The illustrated apparatus 10 includes a beverage support member 32 that extends outwardly from the media support member 14. The illustrated beverage support member 32 is shaped to match the selectably openable aperture 68 of the media support member 14. The beverage support member 32 is configured to pivot upwardly and close off the aperture 68, thereby creating an insulation chamber disposed within the media support member 14.

Figure 6:
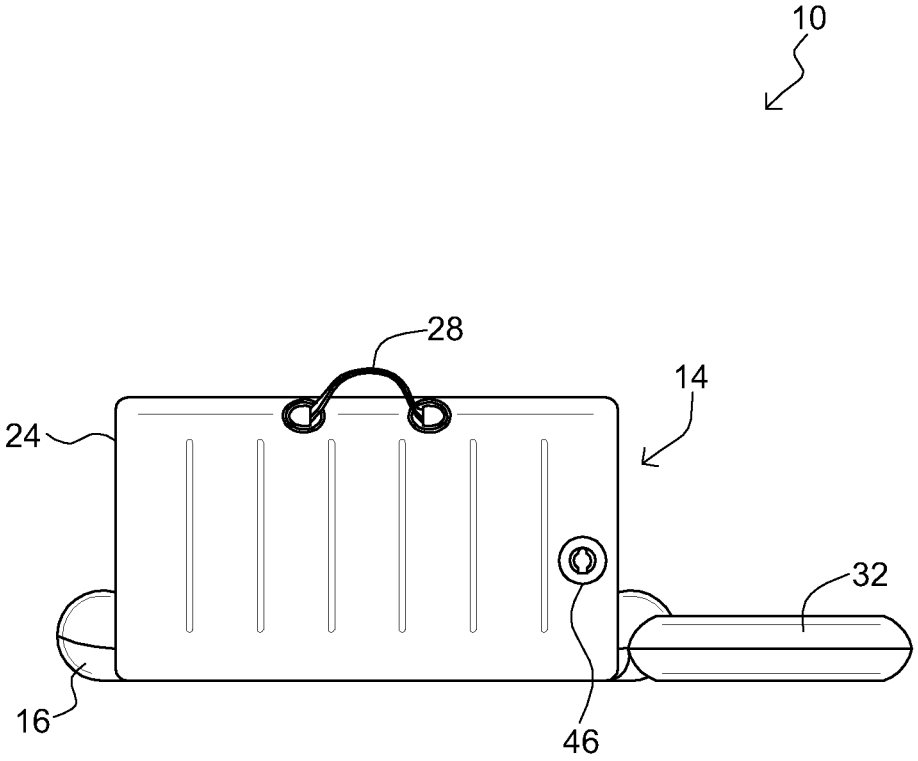
FIG. 6 is a front elevational view of a support apparatus, according to one embodiment of the invention.

FIG. 6 is a front perspective view of a support apparatus, according to one embodiment of the invention. There is shown a support apparatus 10 including a media support member 14 and a base support member 16.

The illustrated support apparatus 10 includes a media support member 14 having a media support structure 24 that is configured to support a media item in a viewable position. The media support member 14 includes a handle 28 that extends upwardly therefrom. The illustrated media support member 14 includes a selectably sealable aperture 46 configured to provide an opening for a user to inflate the media support member 14 to a desired air level. The illustrated apparatus 10 includes a beverage support member 32 that extends outwardly from a side of the media support member 14. The apparatus 10 includes a base support member 16 coupled to the media support member 14.

Figure 7:
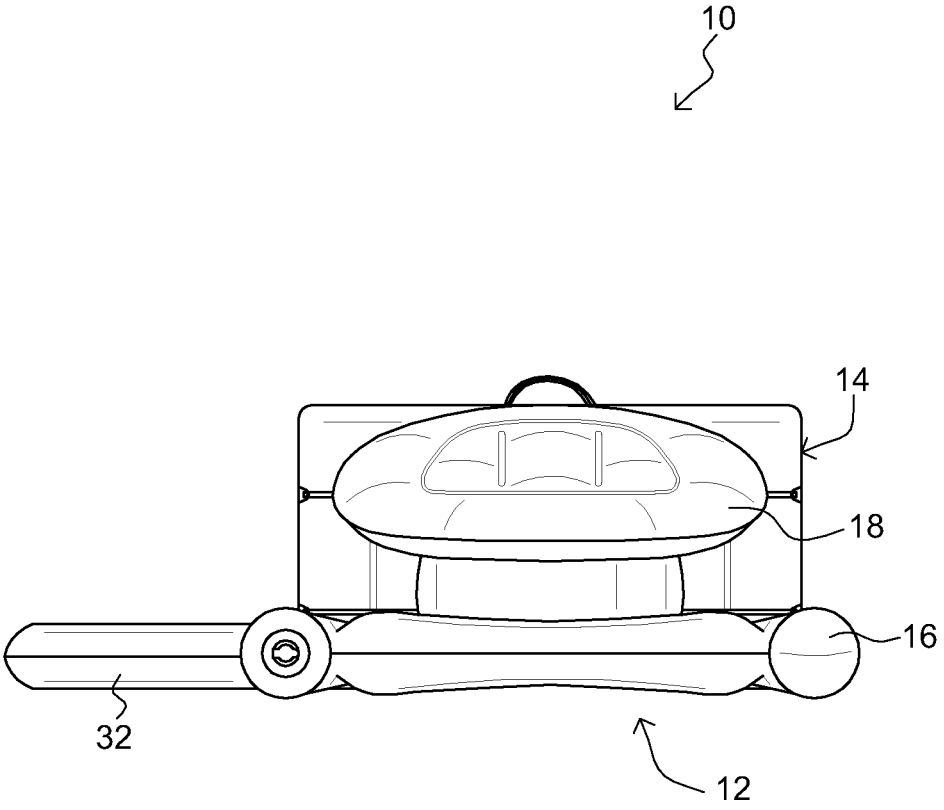
FIG. 7 is a back elevational view of a support apparatus, according to one embodiment of the invention.

FIG. 7 is a back elevational view of a support apparatus, according to one embodiment of the invention. There is shown a support apparatus 10 including an upper body support 12 and a media support member 14.

The illustrated support apparatus 10 includes an upper body support 12 that is configured to support an upper body of a prone user. The upper body support 12 includes a base support member 16 that provides a cushioned surface and is configured to provide stability. The illustrated upper body support 12 includes a chest support member 18 that extends upwardly from the base support member 16 and is configured to provide a cushioned rest for a chest of a user. The chest support member 18 includes a top surface that is angled relative to the base support member 16 such that a face of a user is directed forwardly.

The apparatus 10 includes a media support member 14 that is coupled to a strip, opposite of the upper body support 12. The media support member 14 includes a media support structure that is configured to support a media item in a viewable position. The media support member 14 includes a handle that extends upwardly therefrom. The illustrated apparatus 10 includes a beverage support member 32 that extends outwardly from a side of the media support member 14.

In operation of one embodiment of the invention, a user couples the various members together at desired positions and in the desired configurations and lays the apparatus on a surface where the user intends to rest/read. The user than lies on the support in a desired manner, such as but not limited to being face-down on the chest support with arms extended between the chest support and media support over the strip and manipulating a media item supported on the media support. The user may access the interior of the media support for desired items and may partake from beverage containers stored in the beverage support.

Figure 8:
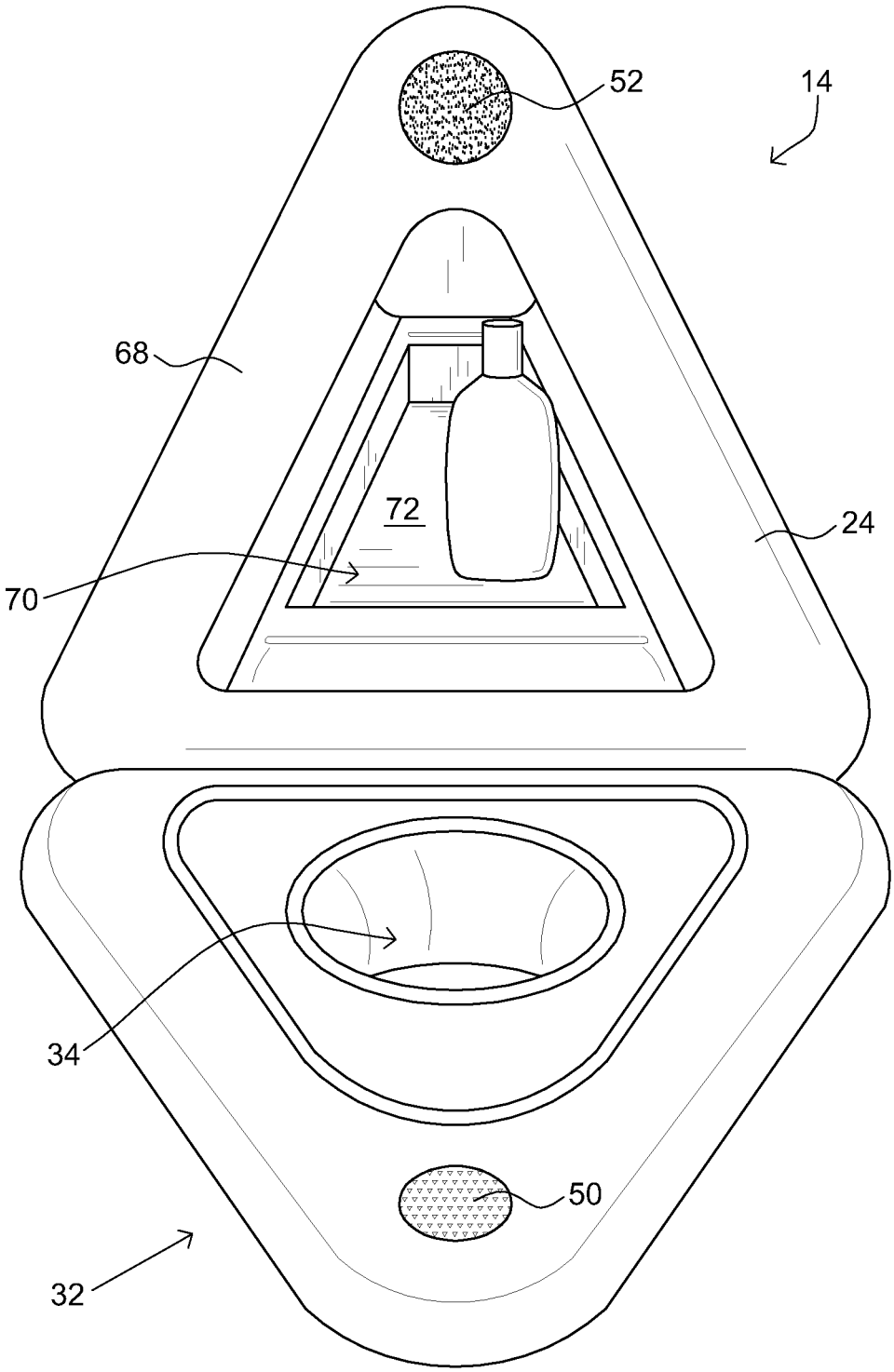
FIG. 8 is a side perspective view of a media support member of a support apparatus, according to one embodiment of the invention.

FIG. 8 is a side perspective view of an insulation chamber of a media support member, according to one embodiment of the invention. There is shown a media support member 14 and a beverage support member 32 of a support apparatus.

The illustrated media support member 14 includes an insulated chamber 70 disposed within the media support structure 24 of the media support member 14. The media support member 14 includes a selectably openable aperture 68 configured to allow access to the insulation chamber 70 disposed therein. The illustrated insulation chamber 70 includes a recessed portion 72 configured to secure and support items disposed therein.

The support apparatus includes a beverage support member 32 extending outwardly from a side of the media support member 14. The beverage support member 32 includes a cavity 34 configured to secure and support a beverage container. The illustrated cavity 34 includes a cylindrical cavity 43 configured to support a beverage container. The illustrated beverage support member 32 is configured to be sized and shaped to cover the selectably openable aperture 68 of the media support member 14. The beverage support member 32 is sized and shaped to match the profile of the media support structure 24, thereby creating the insulated chamber 70 disposed within the media support member 14.

In one embodiment of the invention, there is an adjustable (possibly four or five position) "back pack chair" that may have an adjustable ottoman for leg length not only when used in the upright position but also when lying prone. The chest piece may be "inserted" into the back rest of the chair through a cavity thereof. The center piece and the media holder may be roll-able and rolled up and may have a pouch in the backpack of the chair and/or may be used as a neck support. The user may inflate the chest piece while using the device as a chair and it would act as a pillow. While placing the chair in the lay down position the head rest portion of the chair may have a support bar that may be used to give the upper part of the chair more stability when lying flat. The chest piece may be utilized just as if placing the original product on a chaise lounge. When the media holder is inflated it may extend beyond the top of the chair with a support arm to hold it and the top bar of the chair may be shaped such that it will become the resting place for the bottom of a book or other media.

Advantageously, an embodiment of the apparatus is inflatable, easy to use, and/or comfortable. The chest support allows one to lie in a plurality of positions and be supported thereon in a plurality of configurations and/or modes. One may read, sunbathe, relax, and etc. thereon. An embodiment of the apparatus is multifunctional and/or adjustable to varying heights, lengths and/or weights of users. The center piece or strip may keep sand and other debris from the region between the chest support and the media support. A user may read hands-free while using an embodiment of the apparatus. Wherein page straps are flexible and/or elastic, pages may be turned without removing media from the apparatus. A user may comfortably look up and around because of angled and elevated chest support. There may be a carry strap coupled to an exterior of the apparatus such that when the apparatus is intended to be stored, it may be wrapped by the carry strap. Such is particularly advantageous wherein the apparatus is deflate able.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the Figures illustrate an inflatable apparatus, one skilled in the art would appreciate that the apparatus may be comprised of a foam upper body support and a foam media support member and still perform its intended function.

Additionally, although the figures illustrate an insulation chamber, one skilled in the art would appreciate that the insulation chamber may include a lid configured to secure the contents of the chamber therein and still perform its intended function.

It is envisioned that, one skilled in the art would appreciate that, the upper body support, the media support member, the strip, and the beverage support member may vary in size, shape, design, configuration, color, length, height, width, etc. and still perform its intended function.

It is also envisioned that there may be versions adapted for use by adults and for children, such that the sizing, proportions, decorations and accoutrements may be optimized for use by such and other demographic groups.

There may be a version adapted for use by pregnant women. Such may include a taller armrest shelf that may be longer and/or configured to be movable/adjustable/curvable between various positions such that it may provide additional/further support to portions of a pregnant woman's body, such as but not limited to sides, arms, belly, hips, and the like.

It is expected that there could be numerous variations of the design of this invention. An example is that one embodiment may be formed as a single unit that may be configured with permanent couplings between portions/members/sections. Such a version may be more sturdy than otherwise and may be more suited to use in a pool than others.

Finally, it is envisioned that the components of the device may be constructed of a variety of materials, such as but not limited to: plastic, plastic composite, textiles, rubber, flexible material, waterproof material, etc. and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A support apparatus configured to support a prone user in a position conducive to interacting with a media item that is also supported thereon, comprising:

a) an upper body support configured to support an upper body of a prone user in a position such that a face of a user is elevated, including:

a1) a base support member providing a cushioned surface and configured to provide stability; and a2) a chest support member extending upwardly from the base support member and configured to provide a cushioned rest for a chest of a user, wherein the chest support member includes a top surface that is angled relative to the base support member such that a face of a user is directed forwardly; wherein the chest support member is removably coupleable to the base support member;

b) a strip extending frontwardly from the upper body support, wherein the strip is a sheet of flexible material having a width substantially equal to the base support member; wherein the strip includes a removably coupleable device selected from the group of coupling devices consisting of: snaps, buttons, hook and loop, tongue and groove, clips, clamps, and magnets;

c) a media support member coupled to the strip, opposite of the upper body support, and including a media support structure configured to support a media item in a viewable position; wherein the media support member includes a plurality of elongated restraining members coupled across an operating surface of the media support member; wherein the media support member includes a handle extending upwardly therefrom; wherein the media support member includes an insulation chamber configured to store items;

d) a beverage support member extending outwardly from the media support member and including a cavity; and e) wherein one of at least the upper body support and the media support member is inflatable; wherein the strip is removeably coupleable to at least one of the media support member and the upper body support.

* * * * *